United States Patent [19]

Rewitzer

[11] 4,224,780

[45] Sep. 30, 1980

[54] PROCESS AND APPARATUS FOR COMPRESSING AND PACKAGING FILAMENT TOWS

[75] Inventor: Siegfried Rewitzer, Ihrlerstein, Fed. Rep. of Germany

[73] Assignee: Hoechst Aktiengesellschaft, Frankfurt am Main

[21] Appl. No.: 932,614

[22] Filed: Aug. 10, 1978

[30] Foreign Application Priority Data

Aug. 12, 1977 [DE] Fed. Rep. of Germany ..... 2736316

[51] Int. Cl.[3] ..... B65B 1/24; B30B 15/06

[52] U.S. Cl. ..... 53/436; 53/528; 100/295; 141/12; 141/73

[58] Field of Search ..... 53/436, 527, 523, 526, 53/528, 529; 100/295; 141/12, 73, 80

[56] References Cited

U.S. PATENT DOCUMENTS

| | | | |
|---|---|---|---|
| 2,798,348 | 7/1957 | Weber et al. | 53/529 X |
| 3,384,007 | 5/1968 | Boje et al. | 53/527 X |

*Primary Examiner*—Travis S. McGehee

*Attorney, Agent, or Firm*—Curtis, Morris & Safford

[57] ABSTRACT

The invention provides a process for compressing filament tows to bales and packaging them with flexible packaging material and reinforcing strips by means of a novel baling press, the press ram of which is divided into a core ram (4) and a surrounding outer ram (5), so that the relative positions of these two rams may be varied during the compression operations. By means of fingers (10), the collar of packaging material formed on compression can be bent in such a manner when lifting the outer ram (5) that on renewed lowering of the outer ram (5) strip-reinforcement is not hindered any more.

Bales of high unit weight are obtained which allow trouble-free processing of the filament tows.

10 Claims, 8 Drawing Figures

Figure 1C:
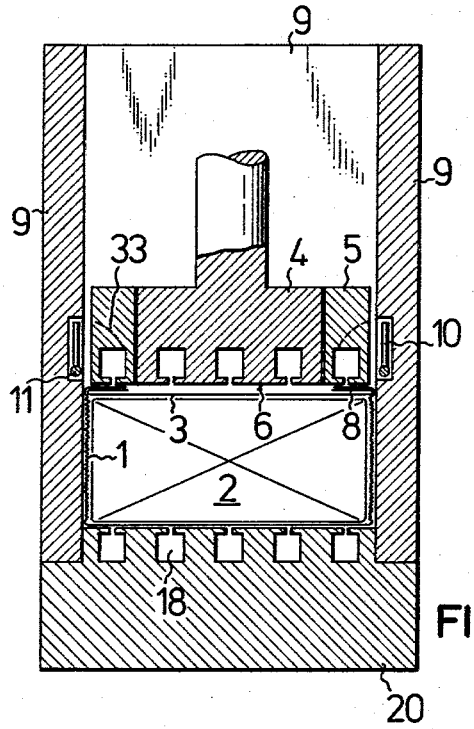

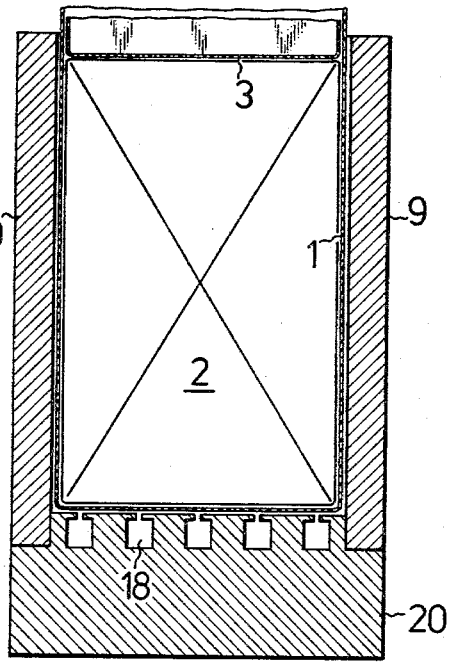
FIG. 1
FIG. 1a
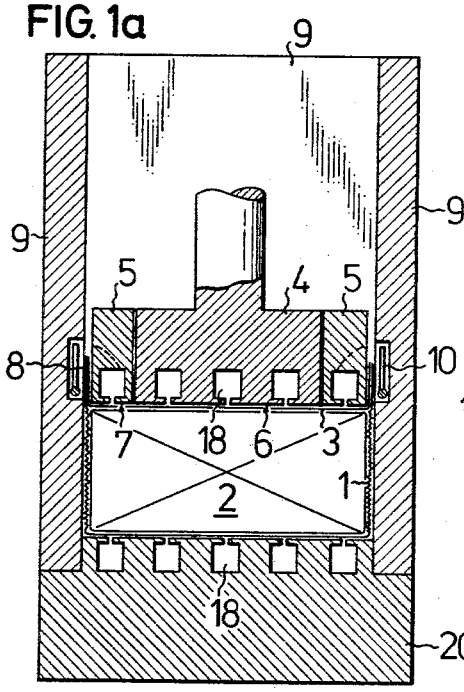
FIG. 1b
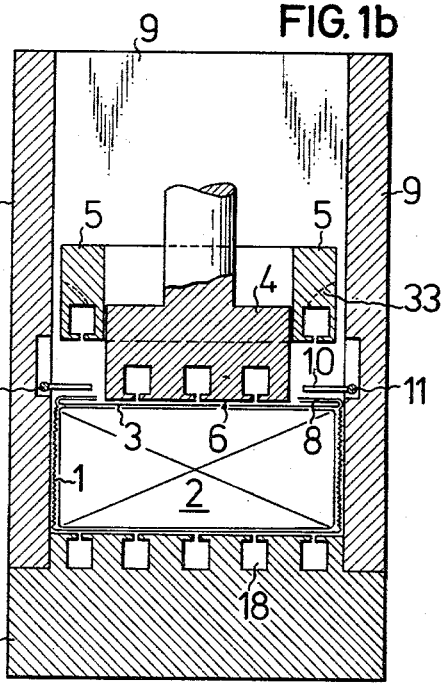

9
12
13
9
14
14
9
15
22
16
4
5
5
33
10
11
6
18
7
11
19
23
21
18
20

PROCESS AND APPARATUS FOR COMPRESSING AND PACKAGING FILAMENT TOWS

This invention provides a process for packaging fliament tows and a correspondingly suitable press.

As starting material for the manufacture of stable fiber yarns from synthetic fibers, there are used to an increasing extent filament tows which are converted to staple fibers at the yarn manufacturer's using only cutting and/or breaking devices. For packaging such filament tows, dimensionally stable cardboard boxes are used, where one filament tow each is deposited in zigzag layers. A very uniform deposition avoiding for example any buckling of zigzag layers is required in order to ensure trouble-free processing later on.

An essential disadvantage of packaging filament tows in cardboard boxes is the low charging weight (or unit weight). For shipping a given weight amount of a filament tow, a very high transport volume and a considerable number of package units are required. On the other hand, the yarn manufacturer is interested in receiving filament tows as long as possible in one package unit in order to reduce the number of tow string up operations and thus to save labor.

Increase of the charging weight, thus saving packaging material and increasing the length of tow per package unit, can be achieved for example according to the process of German Pat. No. 1,239,656, by pressing each double layer of the filament tow introduced into the box. This method, and optionally an additional compression of the total goods, yields a unit weight of, for example, about 200 to a maximum 300 kg/m$^3$ in the case of polyacrylonitrile filament tows. However, these values are still insufficient.

Generally, the filament tows to be packaged consist of intensely crimped individual filaments. On compression of the tows deposited in zigzag formation, the high bulk elasticity acts against the compressive force, and the internal pressure of the tow material on the walls of the cardboard box increases with increasing compressive force. Therefore, when using the generally suitable cardboard packaging material, the compressive force cannot be increased as desired, because (1) the bulk elasticity of the tow material, on pressure release, causes a spontaneous increase of the volume, so that the expanding goods prevent closing of the boxes, and (2) the internal pressure of the packaged textile material increases in such a manner that the dimensional stability of the cardboard boxes becomes insufficient to control it. Of course, the dimensional stability of the boxes could be increased by additional reinforcing means, for example by applying steel strips or tension wires, while the edges of the boxes would have to be provided with special protecting devices which prevent the strip-reinforcement from cutting into the cardboard. However, such reinforcement of the cardboard boxes has never been applied hitherto in industrial practice, because it would considerably raise the cost of the already very expensive cardboard box package.

In order to increase the unit weight of packaged, deposited filament tows, two methods have been hitherto chosen, which, however, show quite a number of drawbacks.

Attempts have for example been made to reduce the bulk elasticity of the goods to be packaged by steam treatment. Steaming of a deposited and optionally precompressed textile material, however, requires high expenditure and involves furthermore the risk of producing inhomogeneities in the filament material. Such steam treatment can be carried out only in large autoclaves, and after evacuation, a multi-step steam treatment is recommended in order to ensure penetration of the steam to the core of the deposited goods. Even when strictly observing these precautions, it is practically impossible to obtain uniform steaming of the outer zones and inner layers, and it is known that such inhomogeneous steam treatment results in uneven dyeing of the material.

Another method for increasing the unit weight is described in British Patent No. 1 310 029. According to this process, the filament tow to be packaged is deposited in a bag of airtight material, which is made as airtight as possible by means of a cover made from the same material, and subsequently, the air is evacuated from the packaged goods, so that they are compressed without any precompression to about 35% of their initial volume by means of the air pressure on the outside of the bag. The disadvantages of this process are the following: The compressive force cannot be increased as intended, so that the unit weight of the goods so packaged remains insufficient. Furthermore, there is the risk that the loops of the tow, initially deposited in loose manner, become entangled on volume reduction, since in this process the textile material is compressed from all directions. Entangled or shifted loops of the tow, however, cause inevitably difficulties during the processing of such filament tows.

German Utility Model No. 7,635,849 describes a very expensive method of packaging. Although in this case strip reinforcement may be avoided, adhesive links between the individual layers of this package have to be established which automatically require much time and labor. Moreover, the unit weight obtainable is also insufficient.

It is the object of the present invention to provide an optionally automated process and suitable apparatus for compressing and packaging filament tows to bales of high unit weight while using simplest packaging materials usually employed in the textile industry. By high unit weight, there is to be understood a unit weight of about 500 kg/m$^3$ or more for a package of tows of crimped polyacrylonitrile filaments, for example. Being the simplest and cheapest bale packaging material, the use of plastics sheets or film strips, optionally also jute fabrics, and reinforcement by means of steel strips or wires is intended.

Such packaged bales and the presses suitable for forming these bales have been known for a long time in staple fiber packaging. Application of these baling presses for filament tows, however, is impossible because compressed filament tows display insufficient stability on lateral opening of the press as is usual. Contrary to the substantially complete random distribution of staple figers on compression, filament tows are deposited in loops or zigzag formation in such a manner that their lateral cohesion is as low as possible.

In accordance with this invention, the above object is achieved by a new process for packaging filament tows to bales by multi-step compression, which comprises compressing a filament tow deposited in uniform layers and precompressed in a square open bag of flexible packaging material to a bale of high unit weight in a novel baling press. In this process, the open, flexible packaging bag is first lap-covered by means of packaging material, the tow is then compressed by lowering the entire press ram, subsequently, the pressure on the rim zones of the covered top area of the bale is released by lifting the outer ram, the projecting rims of the packaging material are bent towards the center of the press chamber and maintained in this position at least until the pressure in the rim zones is equalized to that of the core zone by lowering the outer ram again. Optionally, the entire press ram may then be further lowered. The bale so obtained is then reinforced in usual manner by means of strips, wires, etc..

By means of known depositing devices, for example according to German Patent No. 1,239,656, the filament tow may be deposited as follows in uniform, for example zigzag, layers in a square open bag of flexible packaging material: first, this square, flexible bag is introduced into a supporting receptacle, preferably without bottom and cover, and the filament tow is deposited and precompressed in this bag. Subsequently, the bag containing the textile material so deposited and precompressed is transported in its supporting receptacle to the baling press, where this receptacle which advantageously has the same cross-sectional dimensions as the packaging bag is removed immediately before introducing the bag containing the deposited filament tow into the press.

Alternatively, the filament tow may first be deposited and precompressed in a suitable supporting receptacle without using a square bag, and then transferred together with the receptacle to the box-type press, where it is introduced into a correspondingly formed square bag contained in the press chamber.

The novel process as described can be carried out only with the use of a baling press in accordance with this invention, the press ram of which is divided into a core ram and an outer ram surrounding it, with the proviso that the position of these two rams with respect to each other, that is, their compression surfaces, can be varied during the compression process.

Preferably, the side walls of the press chamber of this baling press are provided with several rod-shaped or flat fingers at the level of the top surface of the compressed bale. These fingers are inserted in the side walls of the press chamber and can be swung or pushed into the compression zone of the outer ram. In order to prevent contact of the fingers and the outer ram, the latter is provided with corresponding slots or openings. Further preferred features of the baling press in accordance with this invention are described below in connection with the description of the accompanying drawings.

Figure 1D:
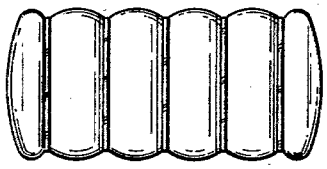
Figure 2:
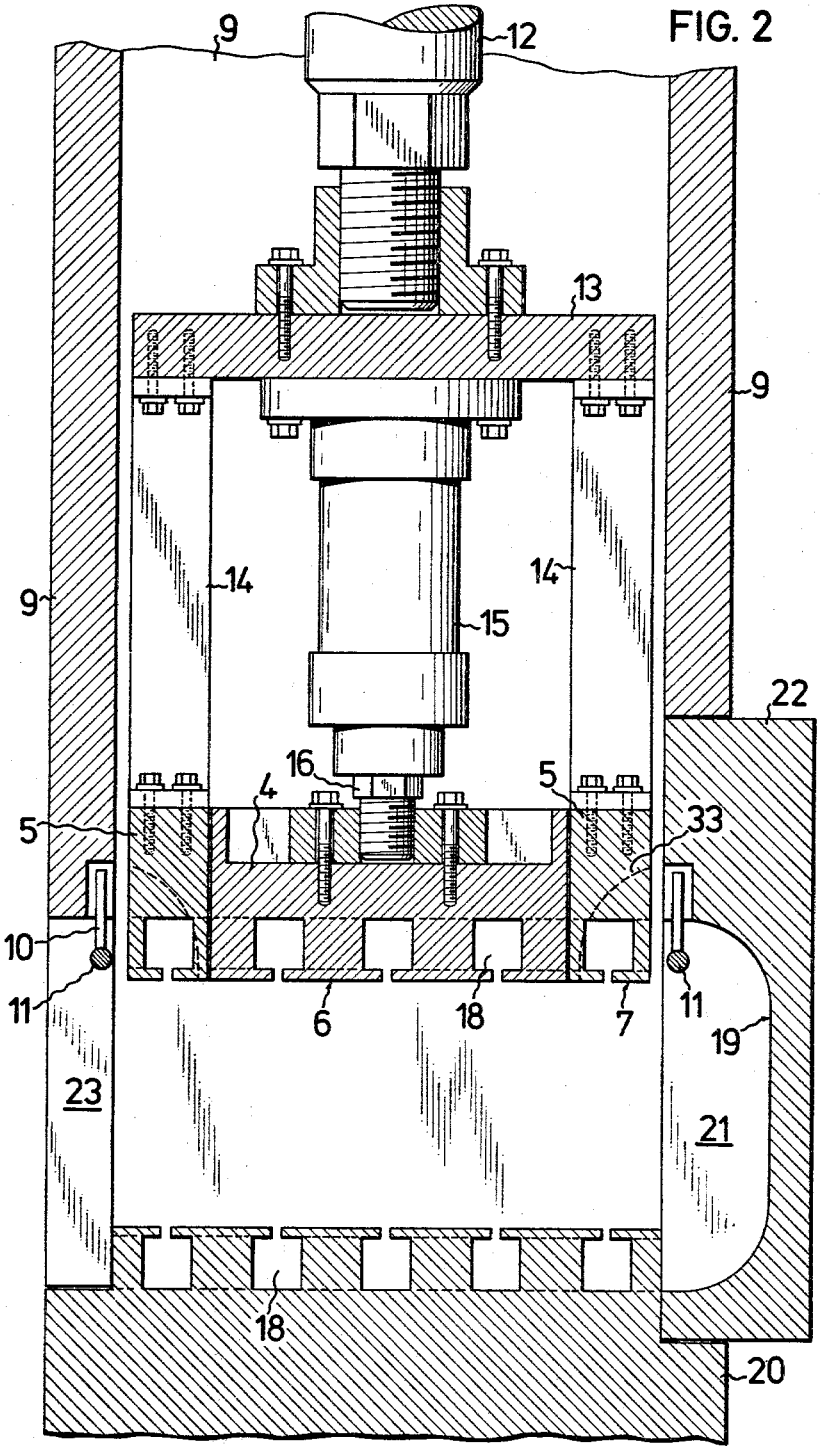
Figure 2A:
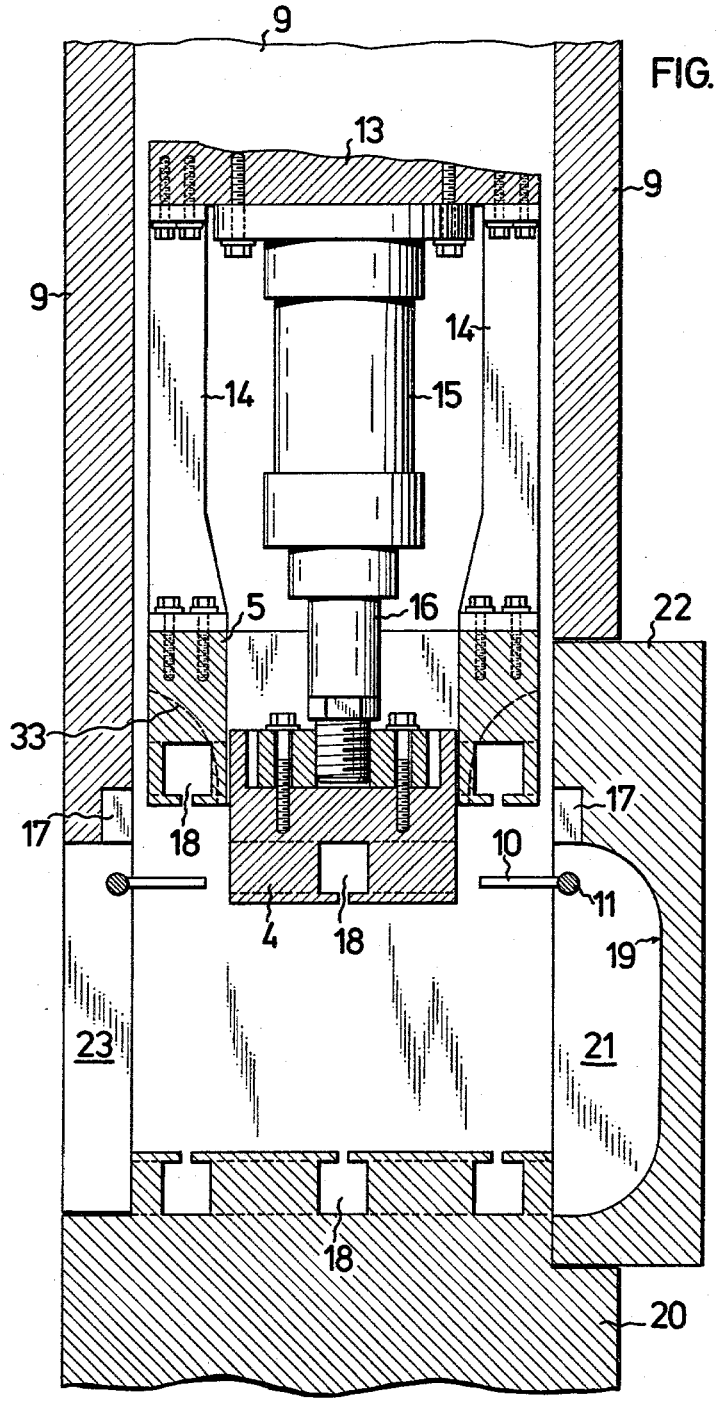
Figure 3:
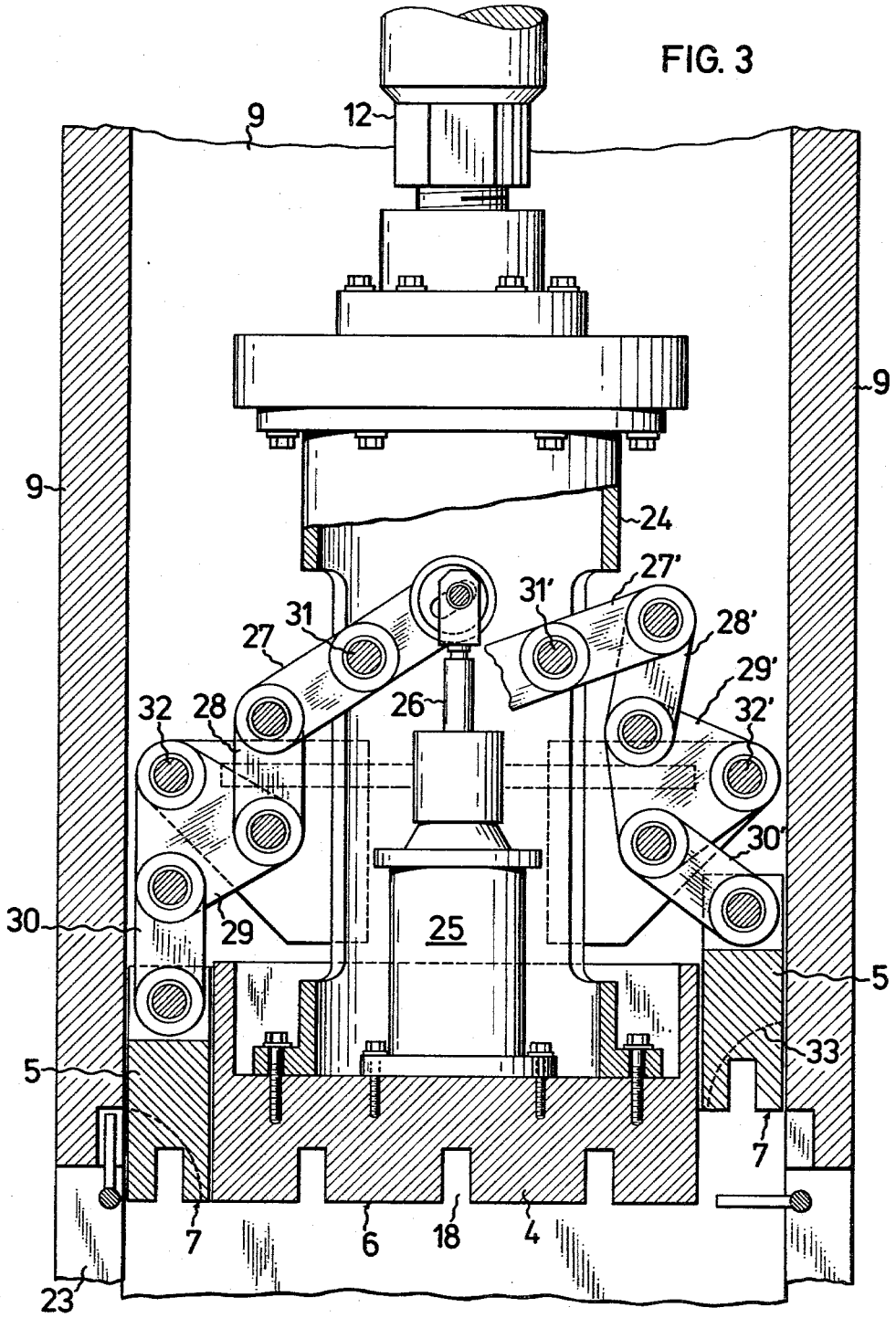

The invention will be better understood by reference to the accompanying drawings, of which FIGS. 1 to 1*d* represent schematic views illustrating the individual operations carried out in the baling press;

FIGS. 2 and 2*a* show an embodiment of a baling press in accordance with the invention, wherein the position of the core ram can be modified with respect to that of the outer ram by means of a hydraulic cylinder; and FIG. 3 illustrates another embodiment of the divided press ram, wherein the position of the outer ram can be varied by means of levers and control cylinders.

The process and the essential operational functions of the apparatus of the invention are explained as follows by reference to FIGS. 1 to 1*d:*

FIG. 1 shows in a schematic view the flexible, square bag (1) containing the deposited and precompressed filament tow (2), the packaging material used as cover (3) and the chamber of the baling press which consists of the side walls (9) and the bottom plate (20).

In FIG. 1*a*, the tow (2) has been heavily compressed by lowering the entire press ram, that is, the core ram (4) and the outer ram (5). The compression surface (6) of the core ram (4) and the compression surface (7) of the outer ram (5) are on the same level. The side walls (9) of the baling press ensure that in this operation the cross-section of the deposited tow remains unchanged as compared to its state as shown in FIG. 1. In this compressing operation, the packaging material of the square bag (1) is squeezed and thus folded. In any case, an overlap of the packaging material of the square bag (1) and the cover (3) is thus formed, which overlap surrounds the outer press ram in the form of a collar (8). Formation of this collar (8) of packaging material is inevitable and cannot be prevented even by precision adjustment of the dimensions of the press ram to those of the side walls (9). On the contrary, at a too close fit of press ram and press chamber, breakdowns occur because of tilting of the ram and/or jamming of the packaging material.

Formation of such a collar cannot be prevented by lifting and lowering the press ram several times, because, due to the high inner pressure of the textile tow material (2), its bulk elasticity ensures that the collar (8), when the entire press ram (4 and 5) is lifted, cannot be bent inwards and fixed in this position.

The collar formed by the packaging material practically prevents any reinforcement of the compressed bale, for example by steel strips, because the corresponding grooves (18) generally present in such presses through which the reinforcing material is passed are closed in this case by the collar (8) which consists of several layers of packaging material. Piercing or cutting of the collar would become possible only when the side walls (9) of the press chamber are removed which, however, would cause the baled textile material bulge outwardly and the deposited loops of the tow to be at least shifted from the correct position, so that a trouble-free processing of this filament material would not be achieved. Moreover, there is the risk that the not yet reinforced square bag (1) would not resist the internal pressure, so that its sides would burst and the single loops of the tow would escape to the outside. In any case, piercing or cutting of the collar would require complicated operations involving dangers for the operators and a possibly substantial destruction of the packaging material.

According to this invention, the collar is eliminated in the following manner:

As shown in FIG. 1*b*, the pressure has now been partially released by lifting the outer ram (5), while the core ram (4) remains in its compressing position. This division of the press ram into a core ram (4) and an outer ram (5) makes it possible to prevent the compressed textile material (2) from escaping, while the rim zones of the top area of the bale and thus the collar become accessible for manipulation. The position of the press rams according to FIG. 1*b* permits bending of the collar (8) of packaging material around its periphery towards the center of the bale by mechanical or pneumatic means. In a preferred embodiment, rod-like fingers (10) are inserted in the side walls (9) of the box-type press, which fingers can be pushed or swung into the press chamber in a manner schematically illustrated in FIG. 1*b*. It is advantageous to insert several of these fingers in each side wall of the press, the fingers being for example linked to one another via a common shaft (11) which ensures control of these rod-like fingers (10) from the outside, for example by a servomotor or a pneumatic drive.

The upright collar (8) of packaging material is bent towards the center of the press by a corresponding movement of the fingers (10), and maintained in this bent position.

Alternatively, air jets may be used at the corresponding places instead of mechanically operating jacks. In this case, the upright collar (8) is bent and maintained in bent position by currents of compressed air.

When the outer ram (5) is provided with suitable recesses or slots (33), it may be lowered again as shown in FIG. 1*c*, so that the compression surfaces (6) and (7) are on the same level again. The fingers (10) may now be moved back through the slots (33) into the side walls (9) of the press chamber. Optionally, aftercompression is possible up to a certain extent; however, care has to be taken that a collar of packaging material is not formed anew. The compressed bale according to FIG. 1*c* without any upright collar of packaging material can easily be reinforced then by steel strips, tension wires and the like, optionally with the aid of known apparatus. In the case where the guide grooves in the side walls, the bottom plate and the press rams are correspondingly placed, reinforcement may be carried out in longitudinal direction to the side walls (9) of the press chamber without releasing the pressure or opening one of the side walls (9) of the press. This mode of operation ensures that the deposited loops of the tow are not shifted from their correct position and do not become entangled, because lateral escape of the bales is safely prevented by the strip reinforement in place.

FIG. 1*d* shows the compressed and reinforced bale ready for shipment.

The above description of the process gives details of its steps which can be carried out using the tow press of the invention. Supplemental details are given below.

Deposition and precompression of the filament tows may be carried out for example according to German Pat. No. 1,239,656 in such a manner that a square packaging bag is introduced into a supporting receptacle having the same dimensions as the bag and the press chamber. By means of the device according to the cited German Patent, the filament tow is charged to the square bag in the supporting receptacle which prevents deformation of the flexible bag during the deposition and precompression operations. Simultaneously, the supporting receptacle protects the deposited and precompressed textile material from mechanical damage during its transport from the deposition device to the box-type press. Preferably, the supporting receptacle has only four smooth side walls, that is, there is neither bottom nor cover. Optionally, the outside surfaces of this supporting receptacle are provided with ears, hooks and the like in order to facilitate handling, or clamping devices are attached to them in order to fix the upper end of the flexible square bag (1) to the top of the receptacle. In a case where damage to the bottom of the bag containing the deposited and precompressed filament tow may possibly occur during transport, it is recommended to use a loosely placed bottom plate which can be easily removed. When using normal tow deposition devices, the pressure on the side walls, despite precompression, is so low that the supporting receptacle can be easily removed before or in the box-type press. A packaging material should be chosen which under these conditions prevents lateral shifting of the filament tow or bulging of the side walls of the bag. Suitable flexible packaging materials are for example smooth sheets made e.g. from polyethylene, or fabrics made from filaments or fibers, optionally coated with plastic material or synthetic resins, and especially film strips. Especially appropriate is the use of so-called film strips or strip fabrics which may be bonded in addition to a smooth sheet material. Alternatively, a jute fabric or a material of staple fiber structure is suitable for packaging as well. The square shape of the bags is achieved for example by sewing or welding of suitable sheet material.

Direct deposition of the filament tow to be packaged into a correspondingly shaped square bag by the deposition device is not compulsory. According to a variation of the process of the invention, the tow may alternatively be deposited in the supporting receptacle referred to above which, in this case, should advantageously be provided with an easily removable bottom plate. The supporting receptacle containing the deposited and precompressed filament material is transferred to the baling press, the press chamber of which has to contain a correspondingly shaped square bag. By means of the press ram, for example, the deposited and precompressed filament material may be pressed directly from the supporting receptacle (after having removed the bottom plate) into the square bag.

However, care has to be taken that the deposited loops of the filament tow or the square bag are not shifted out of place during this operation. Furthermore, also in this variation of the process of the invention, the dimensions of the supporting receptacle, square bag and press chamber should correspond in order to prevent any lateral movement of the filament tow material during the compression operations.

The titer of the deposited filament tow is not limited by the process and apparatus of the invention. It is possible, for example, to deposit, to compress and to bale tows having a total titer of 500 000 dtex or even above 1 000 000 dtex without difficulty. The titer of the filament tows is generally limited by the capacity of the machines used to process the tows to staple fibers.

FIGS. 2 and 2*a* illustrate a possible embodiment of the baling press of the invention. According to this embodiment, the main press piston (12) is fixed to the outer ram (5) by means of a mounting plate (13) and supports (14). A further small pressure cylinder (15) connected to the core ram (4) is fixed to the mounting plate (13). This small pressure cylinder (15) is provided with terminals for hydraulic drive (not shown). In FIG. 2, the piston (16) of the pressure cylinder (15) is lowered to its final position, and the pressure of the main press piston (12) acts now mechanically via the mounting plate (13) on the piston (16) of the pressure cylinder (15). In this position, the compression surfaces (6) and (7) of the core ram (4) and the outer ram (5), respectively, are on the same level. When hydraulic liquid is forced into the small pressure cylinder (15), its piston (16) moves downward together with the core ram (4) connected to the pressure cylinder (15), and when simultaneously the main press piston (12) is lifted at the same speed, the core ram (4) remains in its position without moving, while the outer ram (5) follows the upward movement of the main press piston (12). The side view of FIG. 2*a* illustrates this position of core ram and outer ram. This position allows swinging of the rod-shaped fingers (10) around their common shaft (11) into the press chamber. During the first compression step these fingers are positioned in recesses (17) of the side walls (9) of side wall doors (22) of the baling press. By swinging the fingers (10) which act like levers, the collar of packaging material formed on compression can be bent inward. In cases where the sheet material used for packaging recovers slowly and to a small extent only, fingers (10) may be swivelled back into the recesses (17) before lifting the piston (16) and lowering the main press piston (12), to cause outer ram (5) to reach its position as shown in FIG. 2. In cases where it is not certain that the collar of packaging material will be correctly bent or remain in bent position, the outer ram (5) has to be provided with suitable slots (33) which permit the fingers (10) to remain in their swivelled position as shown in FIG. 2*a*, even when the outer ram (5) is again lowered to the compression level of the core ram (4). The openings (33) in the outer ram (5) have to be designed in such a manner that they allow the fingers (10) to be swung back even at lowered position of the outer ram (5).

After the outer ram (5), has been lowered, that is, after the compression surfaces (6) and (7) are on the same level again, the bale may be strip-reinforced without hindrance from a collar of packaging material. According to FIG. 2, the core ram (4) has three grooves (18) and the outer ram (5) is provided with two similar grooves which allow automatic strip-reinforcement of the compressed bale. Corresponding grooves (18) are formed in the bottom plate (20) of the press. A curved recess (19) in the side wall door (22) and corresponding slots (23) in the opposite side wall (9) permit strip-reinforcement without having to open a side wall or door and without reducing the pressure. According to FIG. 2*a*, the outer ram (5) has two grooves (18) for strip-reinforcement, while the considerably smaller core ram (4) contains only one such groove (18).

FIGS. 2 and 2*a* show an embodiment wherein the fingers (10) are fixed to a shaft (11) by means of which they can be swivelled into the press chamber. Another possible embodiment may consist for example in a horizontal arrangement of the fingers in a corresponding opening of the side wall (9) and the door (22) of the press with their extension into the press chamber as the outer ram is lifted being ensured by a mechanical or hydraulic drive. Such a horizontal arrangement has the advantage of requiring only small openings (33) for the fingers (10) in the outer ram (5). If the ends of the fingers are suitably shaped, for example ball-shaped, damage of the packaging material on extension of the jacks into the press chamber and thus on bending of the collar of packaging material would be prevented.

FIG. 3 shows another embodiment of the divided press ram, according to which the main press piston (12) is directly connected to the core ram (4) via a hollow junction piece (24). This form permits predetermination of the position of the outer ram (5) relative to the position of the core ram (4) by means of a lever system (27) to (30). The position of the lever system is determined by the position of the piston (26) of the hydraulic drive (25). In order to better demonstrate the action of this lever system, the left side of FIG. 3 illustrates the outer ram in its lower final position, that is, the compression surfaces (6) and (7) of the core ram (4) and the outer ram (5), respectively, are on the same level. The right side of FIG. 3 shows the outer ram (5) in lifted position; the corresponding lever system has the numbers (27′) to (30′). This comparison of the positions of the outer ram and its lever system demonstrates that only the pivots (31) or (31′) and (32) or (32′) are fixed centers of motion of the lever system. They are fixed to the junction piece (24). During the compression operation, the pressure energy is transmitted from the main press piston (12) via the junction piece (24), the pivot (32) fixed to it, the triangular piece (29) and the link (30) directly to the outer ram (5) without the action of a hydraulic element. The pressure of the hydraulic ram (25, 26) has to be merely sufficient to prevent a change of position of the triangular piece (29) and the link (30).

What is claimed is:

1. A process for making a compressed bale of a filament tow encased in a flexible sheet packaging material by compressing a mass of said tow in a baling press having a pressure chamber and a reciprocating composite ram in said chamber, said ram comprising a central piston and a relatively movable peripheral piston, said process comprising the steps of positioning in said pressure chamber a partially compressed mass of said tow encased in said sheet packaging material, advancing said ram to compress said bale and form a collar of said packaging material between the periphery of said ram and the internal surface of said pressure chamber, retracting said peripheral piston to a point beyond said collar, bending said collar inwardly and thereafter advancing said peripheral piston to force said collar against the upper surface of said bale.

2. A prcess according to claim 1 wherein said collar is bent inwardly by mechanical means.

3. A process according to claim 1 wherein said collar is bent inwardly by an air blast.

4. A process according to claim 1 wherein the filament tow to be compressed is laid down in a bottomless receptacle and partially compressed, the partially compressed tow is forced into a bag of said flexible material positioned in said pressure chamber, the top of the partially compressed tow is covered with said flexible material and said ram is then advanced as set forth in claim 1.

5. A baling press adapted to be used in compressing filament tows into a bale and encasing the bale in a flexible sheet packaging material, said press comprising in combination a pressure chamber, a composite ram reciprocable in said pressure chamber to compress a mass of filament tow encased in said packaging material within said chamber, means for driving said ram to compress said packaged tow within said chamber and form a collar of said packaging material between said piston and the interior of said chamber, said composite ram comprising a central piston for maintaining pressure on said bale and a relatively movable peripheral piston that is retractable with respect to said central piston to a position beyond said collar, means for bending said collar inwardly toward the upper surface of the compressed bale when said peripheral piston is in its retracted position and means for thereafter advancing said peripheral piston to further compress the peripheral portion of said bale.

6. A press according to claim 5 wherein said collar-bending means comprises a plurality of movable members supported by a wall of said pressure chamber and movable into contact with said collar to bend it inwardly toward the upper surface of said bale.

7. A press according to claim 5 wherein said collar-bending means comprises a plurality of fingers pivotally mounted in a wall of said chamber and swingable inwardly into the path of said peripheral piston.

8. A press according to claim 7 wherein said fingers are connected to an actuating rod whereby they may be simultaneously swung inwardly against said collar.

9. A press according to claim 7 wherein said peripheral piston is provided with grooves that register with said fingers so that said fingers can be swung through the grooves in said peripheral piston when it is in a bale compressing position.

10. A baling press adapted to be used in compressing filament tows into a bale and encasing the bale in a flexible sheet packaging material secured with reinforcing strips, said press comprising in combination an end plate and said walls defining a pressure chamber, a composite ram reciprocable in said chamber and means for moving said ram within said chamber to compress a packaged bale of tow therein against said end plate, said composite ram including a central piston and a relatively movable peripheral piston, whereby the pressures exerted on the central portion and on the peripheral portion of said packaged bale may be separately adjusted, said end plate, said central piston and said peripheral piston having transverse passages extending therethrough communicating with the external surface of the compressed bale whereby reinforcing strips can be passed through said passages to encircle said bale and secure it in its compressed state.

* * * * *